US011262138B2

(12) United States Patent
Dupont et al.

(10) Patent No.: US 11,262,138 B2
(45) Date of Patent: Mar. 1, 2022

(54) EVAPORATOR HAVING AN OPTIMIZED VAPORIZATION INTERFACE

(71) Applicant: EURO HEAT PIPES, Nivelles (BE)

(72) Inventors: Vincent Dupont, Auderghem (BE); Stéphane Van Oost, Rosieres (BE); Vincent De Troz, Joao Pessoa (BR); Mikael Mohaupt, Mignault (BE)

(73) Assignee: EURO HEAT PIPES, Nivelles (BE)

( * ) Notice: Subject to any disclaimer, the term of this patent is extended or adjusted under 35 U.S.C. 154(b) by 58 days.

(21) Appl. No.: 16/605,791

(22) PCT Filed: Apr. 12, 2018

(86) PCT No.: PCT/EP2018/059450
§ 371 (c)(1),
(2) Date: Oct. 16, 2019

(87) PCT Pub. No.: WO2018/192839
PCT Pub. Date: Oct. 25, 2018

(65) Prior Publication Data

US 2020/0124354 A1 Apr. 23, 2020

(30) Foreign Application Priority Data

Apr. 18, 2017 (FR) ..... 1753365

(51) Int. Cl.
*F28D 15/04* (2006.01)

(52) U.S. Cl.
CPC ..... *F28D 15/043* (2013.01); *F28D 15/046* (2013.01)

(58) Field of Classification Search
CPC ..... F28D 15/04; F28D 15/043; F28D 15/046; F28D 15/0233
See application file for complete search history.

(56) References Cited

U.S. PATENT DOCUMENTS 3,598,180 A * 8/1971 Moore, Jr. ..... F28D 15/046 165/133
5,725,049 A 3/1998 Swanson et al.
6,227,287 B1 * 5/2001 Tanaka ..... F28D 15/0233 165/104.26
6,330,907 B1 12/2001 Ogushi et al.
(Continued)

FOREIGN PATENT DOCUMENTS

EP 0987509 A1 3/2000
JP H0814785 A 1/1996
JP H0814785 A * 1/1996 ..... F28D 15/04

*Primary Examiner* — Harry E Arant
(74) *Attorney, Agent, or Firm* — Seed Intellectual Property Law Group LLP

(57) ABSTRACT

A capillary evaporator for a heat transfer system includes a member for picking up heat energy comprising a base (10) and a plurality of projections, each of which extends from the base to a peak (12) and the size of which decreases with increasing distance from the base, and a primary wick (2) made of a porous first material with a front face adjacent to the peak of the projections. The flanks of the projections delimit, with the primary wick, empty spaces that form steam ducts. The flanks of the projections are covered with a thin layer (3) of porous material with the thickest part disposed in contact with the primary wick in the vicinity of the peak of each projection, and the thickness of the thin layer decreases with increasing distance from the primary wick.

16 Claims, 5 Drawing Sheets

(56) References Cited

U.S. PATENT DOCUMENTS

2005/0230085 A1* 10/2005 Valenzuela ..... F28D 15/0233
165/104.26
2009/0314472 A1* 12/2009 Kim ..... F28D 15/043
165/104.26
2013/0168050 A1* 7/2013 Chauhan ..... H01L 23/427
165/104.21

* cited by examiner

EVAPORATOR HAVING AN OPTIMIZED VAPORIZATION INTERFACE

The present invention relates to evaporators, usually used in heat transfer systems with two-phase working fluid.

More specifically, it concerns the vaporization interface where liquid is converted to vapor by absorbing a large amount of thermal energy.

This kind of evaporator is usually used to cool electronic equipment, such as a processor (CPU, GPU), a power module (IGBT, SiC, GaN etc.), or any other electronic component generating heat, or any other heat source.

This type of evaporator is used in a system that comprises a condenser and feed and return lines for circulating the fluid between the evaporator and the condenser.

Current trends in electronics are resulting in having to dissipate significant thermal output on small surfaces.

In the evaporator, at the interface between the capillary wick (which brings the liquid) and the member or plate for receiving/transferring thermal energy (in contact with the primary heat source which supplies the thermal energy), empty spaces are provided that form vapor release channels. These vapor channels are arranged either in the capillary wick or in the thermal energy receiving member. Most commonly, grooves of rectangular cross-section are provided to form such vapor channels, for example as taught by patent U.S. Pat. No. 5,725,049 [NASA].

Some have tried to increase the heat capacity by designing vapor channels of different shapes to increase capacity in terms of heat flux. Indeed, the presence of the vapor channels results in a concentration of the heat flux density in contact with the wick which has led developers to favor what are called "reentrant" grooves, for example as in patent EP0987509 [Matra Marconi Space].

Others have tried to minimize parasitic heat leakage, for example as in patent U.S. Pat. No. 6,330,907 [Mitsubishi], but the formation of vapor bubbles in the area of contact with the wick is not prevented, which endangers the proper supply of liquid to the vaporization zone.

However, it can be seen that the known vaporization interfaces do not allow processing a surface heat flux above 20 Watts/cm$^2$ because the heat exchange coefficients strongly degrade as the heat flux density increases, due to an indentation in the vaporization front inside the primary wick. The increase in the number of vapor bubbles inside the wick increases the risk of drying out, in other words the risk of an interruption in the supply of liquid at this location, a phenomenon that should be avoided.

However, it turns out that the requirements are now even greater, which is why the inventors have sought to optimize the vaporization interface of evaporators in heat transfer loops with two-phase working fluid.

For this purpose, an object of the invention is a capillary evaporator for a heat transfer system, the evaporator comprising:

a thermal energy receiving member (1) comprising a base (10) and a plurality of projections (11), each projection extending from the base to a tip (12) and decreasing in size the further the distance from the base, each projection having side walls (13), a primary wick (2) made of a porous first material and having a front face (20) adjacent to the tip of the projections, the side walls of the projections defining, together with the primary wick, voids forming vapor channels (4), characterized in that the side walls of the projections are coated with a thin layer (3) of porous material, preferably of a second material that is different from the first material.

The term "thin layer" is understood to mean a layer having a thickness of less than 1 mm. The inventors have found that a low thickness associated with the projections advantageously contributes to obtaining good performance.

It should be noted that the thin layer of porous material is in contact with the primary wick at a joining area, at the location where liquid passes from the primary wick to the thin layer of porous material forming a secondary wick.

The term "whose size decreases with the distance from the base" is understood to mean that at least one dimension of the projection (11) decreases, the further one is from the base (10) (i.e. goes decreasing in a direction away from the base).

Advantageously, the liquid-phase fluid is pumped by capillarity from the primary wick into the thin layer that coats the projections at the location where vaporization takes place; the exchange surface area is increased. With these arrangements, an evaporation interface is obtained capable of processing a heat flux greater than 50 Watts/cm$^2$, with much higher heat exchange coefficients W/(m$^2$K) than those of the known art and, depending on the various possible configurations, the evaporation interface will even be able to process tens or even hundreds of Watts/cm$^2$.

Also, one will note that in the area of the projection tips, the heat flux transferred directly to the primary wick is greatly reduced relative to the total heat flux (vaporization is primarily on the walls) and therefore this avoids creating a boiling phenomenon in the area of contact with the primary wick, in other words avoids overheating the primary wick. Thus, the parasitic flux transfer is limited both by greatly reducing the penetration of the vaporization front into the primary wick and also by reducing the overheating of the receiving member while facilitating the extraction of vapor created in the dedicated channels.

In various embodiments of the invention, one or more of the following may also be used:

According to one option, the thin layer may have a substantially uniform thickness. In this configuration, a relatively simple method for manufacturing and assembly can be provided by using a metallic woven fabric which is closely connected to the surface of the receiving member.

According to one option, the thin layer may have a non-uniform thickness, the thickest portion (31) of the thin layer being in contact with the primary wick in the vicinity of the tip of each projection, and the thickness (EC) of said thin layer decreasing the further one is from the primary wick. This configuration makes it possible to obtain a better overall performance in terms of power dissipated per unit surface area.

According to one option, the thermal energy receiving member may comprise a plate, which corresponds to a flat configuration for the heat source to be cooled.

According to another option, the thermal energy receiving member may have a general cylindrical shape, which can correspond to a cylindrical configuration for the heat source to be cooled, which is as common as the flat configuration. This cylindrical configuration is common when using a high pressure fluid, such as ammonia for spatial applications; in this case one can have a flat plate, usually of aluminum, assembled on the outer surface of the cylindrical evaporator.

According to one option, the projections may advantageously be formed in the shape of rectilinear ribs of trapezoidal (or even triangular) cross-section; the thermal energy receiving member is thus easy to manufacture by extrusion or simple machining (milling). Moreover, such a trapezoidal cross-section allows a robust transmission of mechanical forces, in particular those induced by the compressive assembly of the power modules on the evaporator by screwing (which does not allow the conventional thin fins which have a substantially constant thickness along their height, in particular with copper).

According to one option, the projections are adjacent to one another and each vapor channel (4) has a generally triangular cross-section with one of its points directed towards the base of the receiving member. The density of the areas covered by the thin layer is thus maximized and therefore so are the heat exchanges, for a given total available surface area.

According to one option, the cross-section of the projections forms a symmetrical isosceles trapezoid (i.e. a "tooth"), with the short side having a length of at most 20% relative to the length of the long side; in other words, D3<0.2 W. Vapor channels of sufficient dimension are thus formed; in particular their width between the tips of the projections allows a rapid flow of vapor without excessive pressure losses.

According to one option, the small side D3 (in other words the width of the tip) has a dimension <0.3 mm. The inventors have noticed that, contrary to the preconceptions of those skilled in the art, a thinness of the tips is not problematic and is even an advantage if this is combined with the presence of the thin layer, because it avoids the appearance of the vapor phase in the liquid supply zone and limits the parasitic flux transfer through the primary wick.

According to one option, for the geometry of the cross-section of the projection, the half-angle at the tip $\alpha$ is less than 45° and is preferably comprised between 5° and 30°.

This corresponds to the fact that the height of the projections H2 is greater than ½ their expanse W on the base, which partly explains the increase in the efficiency of the exchanges, due to an increase in the effective surface area.

According to one option, the primary wick is preferably obtained from a material that is a poor thermal conductor, such as nickel, stainless steel, ceramic, or Teflon, typically with a thermal conductivity of less than 100 W/mK. This prevents heating the liquid located on the other side of the primary wick and greatly reduces parasitic thermal leakage.

According to one option, the thin layer is obtained from a good thermal conductor, such as copper or aluminum, typically with a coefficient greater than 100 W/mK and preferably greater than 380 W/mK.

This encourages good heat diffusion in the thin layer and good distribution of the vaporization locations.

According to one option, the diameter of the pores of the thin layer is smaller than the diameter of the pores of the primary wick. The supply of liquid to the thin layer from the primary wick and inside the thin layer from the thickest part of said thin layer is thus encouraged.

According to one option, the thickness EC of the thin layer is less than 0.5 mm, preferably wherever the thin layer is in contact with the thermal energy receiving plate 1. The inventors have found that advantageously such a small thickness is sufficient for obtaining good performance. Moreover, one will note that the thermal energy receiving plate is not flat (presence of projections 11) unlike certain embodiments of the prior art.

According to one option, the thickness H1 of the base is comprised between 0.5 and 5 mm. This thickness is adjusted in order to obtain sufficient rigidity and strength for the assembly, for example by screwing, of the component to be cooled.

According to one option, the height H2 of the projections is comprised between 0.5 and 3 mm. This height is adjusted to obtain a sufficient flow area in the vapor channels to avoid potential problems with pressure loss.

According to one option, the projections are formed in the shape of circular ribs. This can be used in the case where the evaporator is in disk form.

According to one option, the projections are formed in the shape of a conical stud or a pyramidal stud. The surface efficiency can be further improved and, depending on the manufacturing methods used, the cost price of the coated thermal energy receiving plate can remain reasonable.

According to one option, the thickness E2 of the primary wick is constant and preferably between 1 and 8 mm. Such a simple primary wick is an available and inexpensive material.

According to one option, the tip of the projections is in contact with the primary wick on a surface area that is less than 20% of the effective surface area of the primary wick.

The invention also relates to a heat transfer system comprising an evaporator as described above, a condenser, fluid pipes with either gravity pumping, namely a thermosiphon configuration (including "pool boiling" configurations), or pumping that is capillary only or combined with a jet, or an evaporator supplied by a mechanical pump.

Other aspects, objects, and advantages of the invention will be apparent from reading the following description of an embodiment of the invention, given as a non-limiting example. The invention will also be better understood by referring to the accompanying drawings in which.

Figure 2:
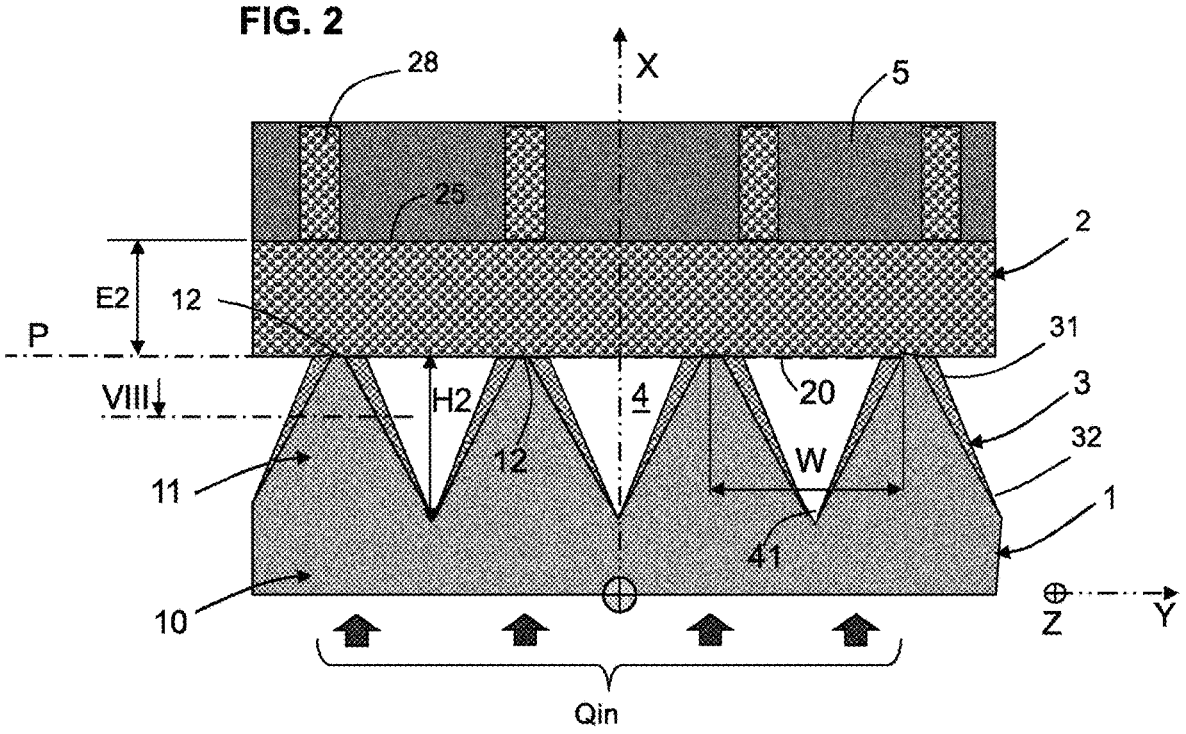
FIG. 2 is a partial cross-sectional view of an evaporator according to a first embodiment, along a sectional plane II-II visible in FIG. 1.
Figure 4:
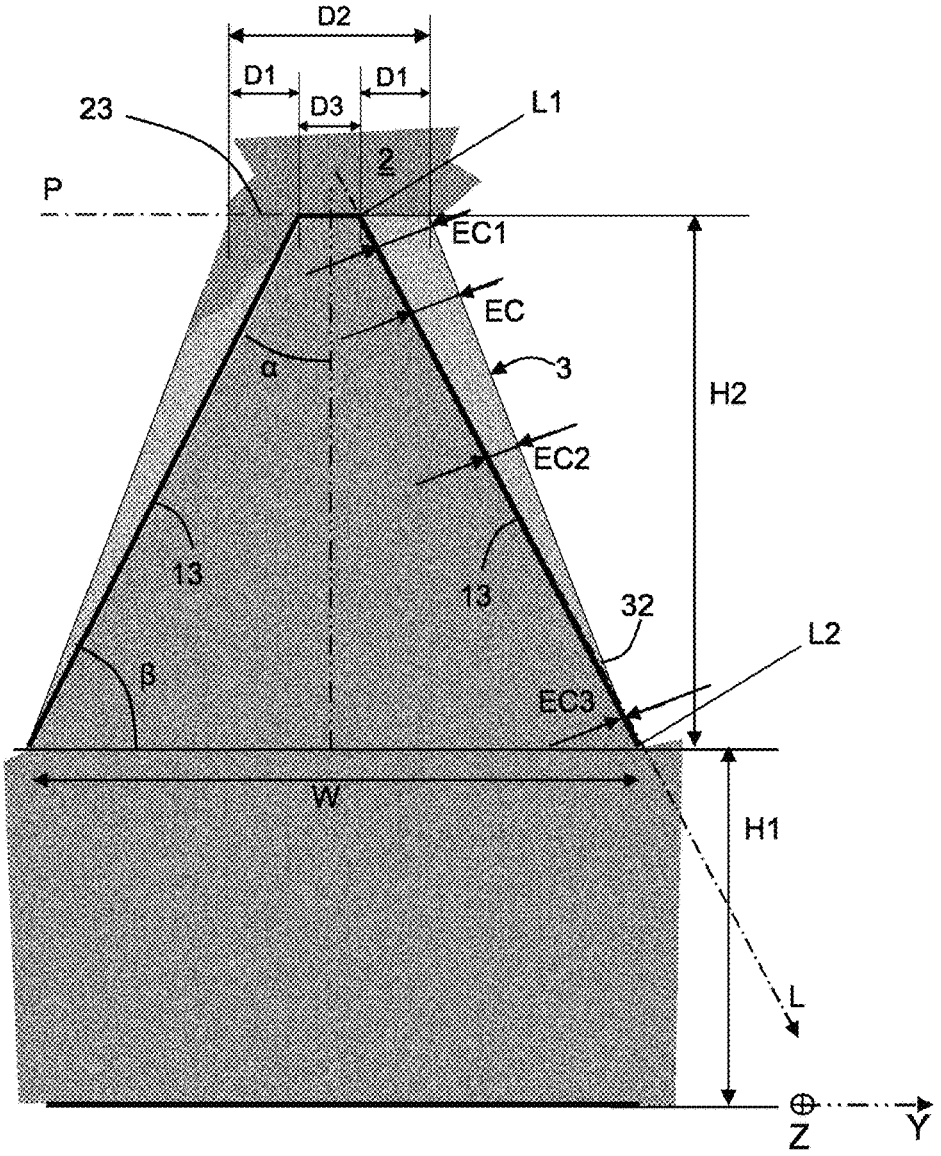
Figure 5:
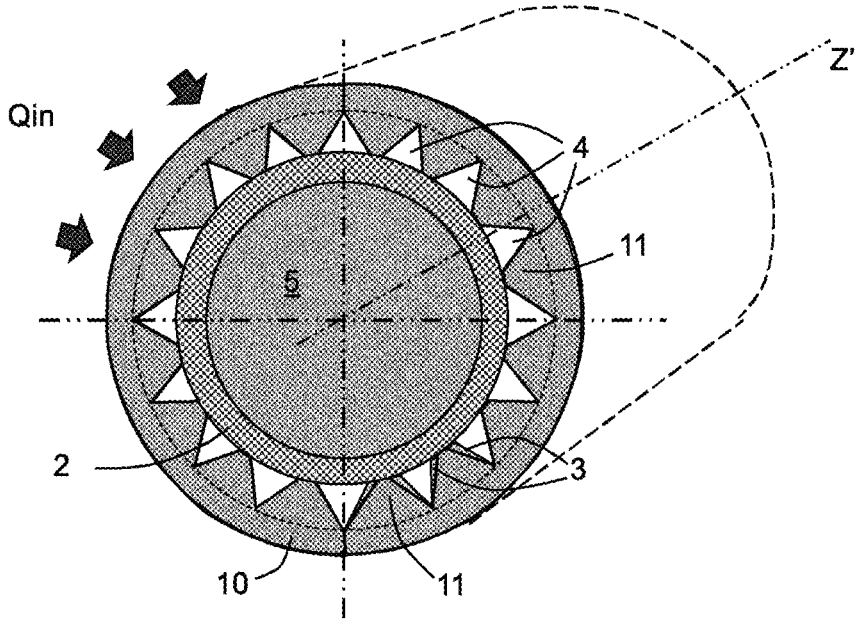
Figure 6:
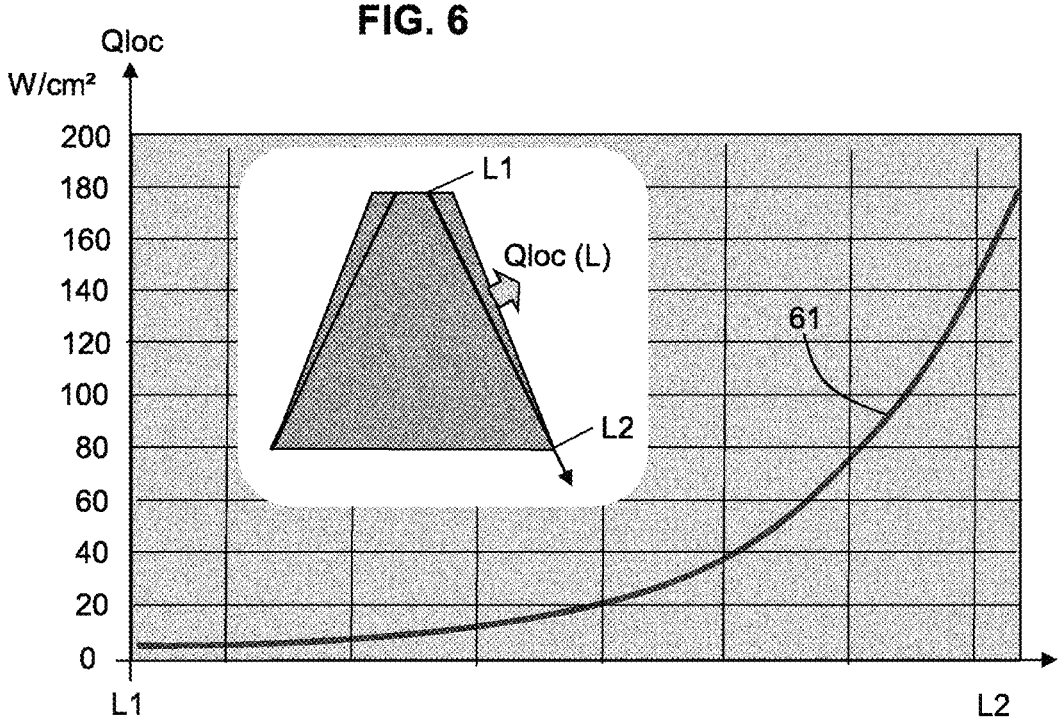
Figure 7:
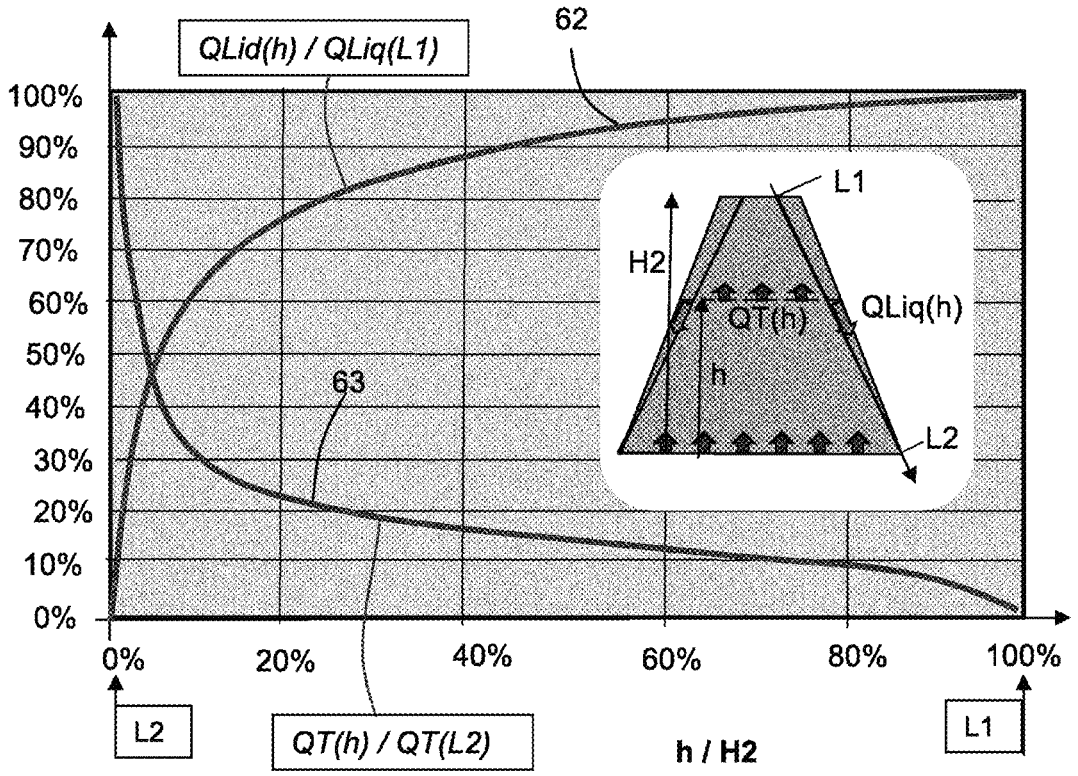
Figure 8:
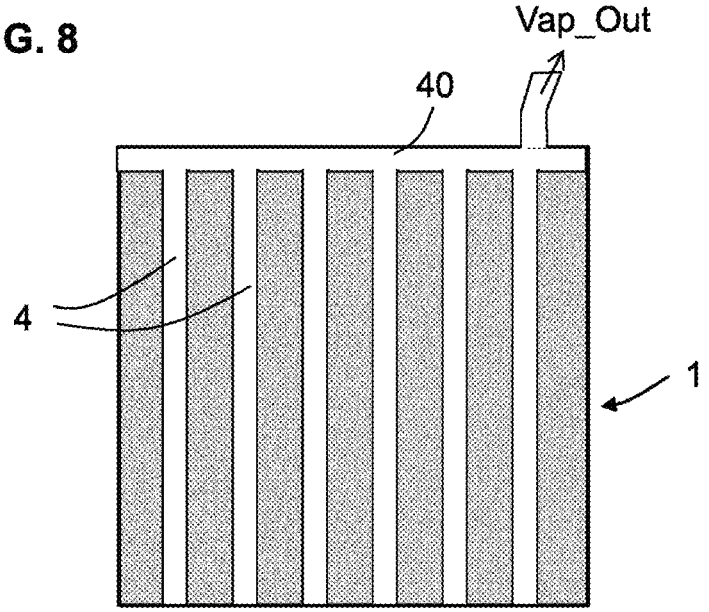
Figure 9:
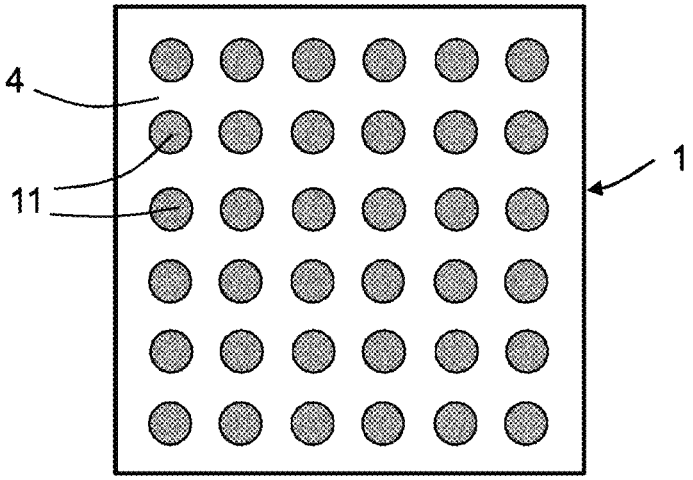

FIG. 4 shows a portion of the cross-section in greater detail, illustrating a projection and its porous coating, FIG. 5 represents a second embodiment, of the cylindrical evaporator type (instead of flat), FIG. 6 represents the distribution of the vaporization flux along the wall of the projections coated with the thin layer of porous material, FIG. 7 represents the heat flux inside the projection as well as the supply flow of liquid along the thin layer, FIG. 8 illustrates the arrangement of the vapor channels in a horizontal section view along the sectional plane VIII-VIII visible in FIG. 2, FIG. 9 is a schematic horizontal section view of an evaporator with studs, which represents another alternative embodiment.

Figure 10:
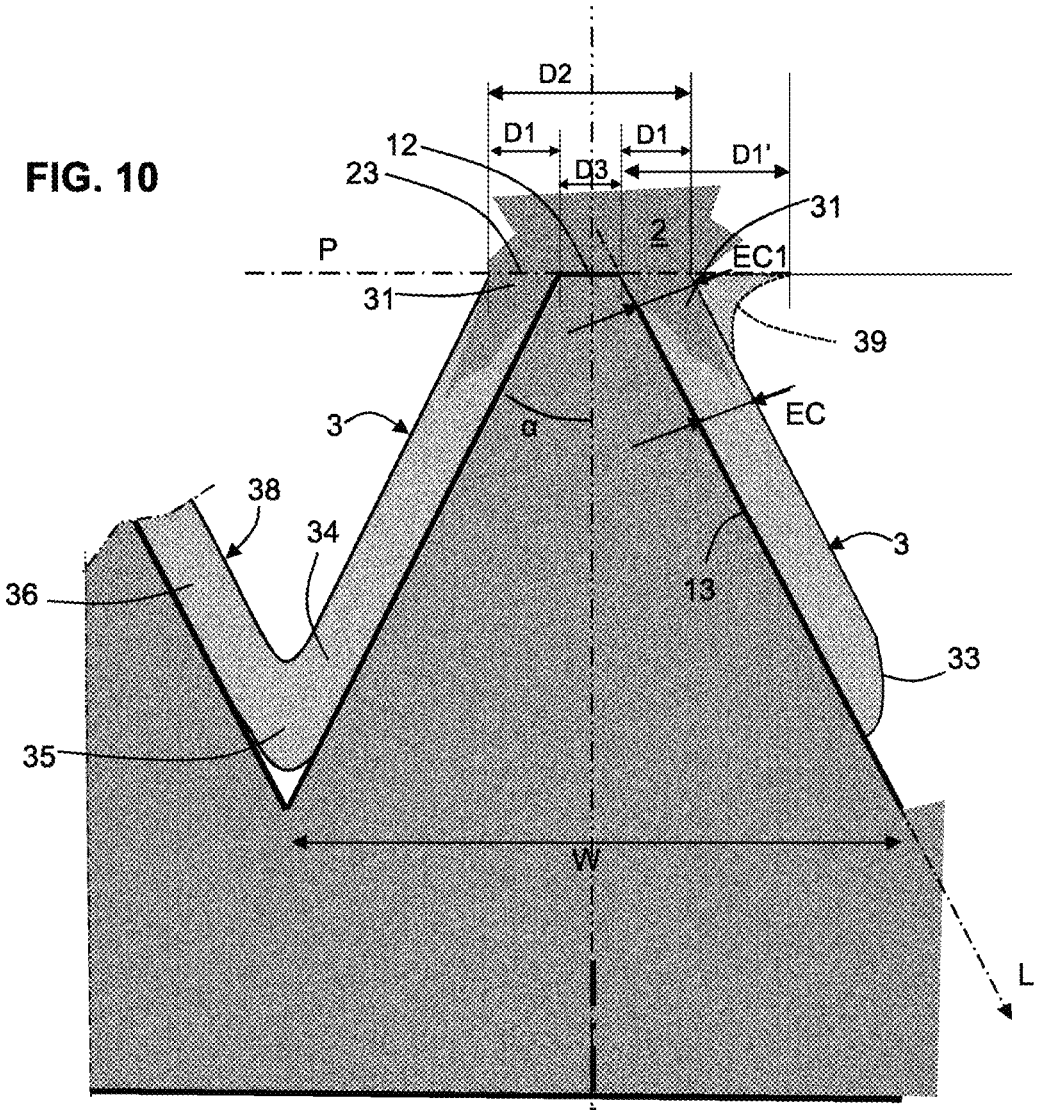

FIG. 10 illustrates two alternative embodiments concerning the configuration of the thin layer of porous material.

In the different figures, the same references designate identical or similar elements. For the sake of clarity, some dimensions are not represented to scale.

Figure 1:
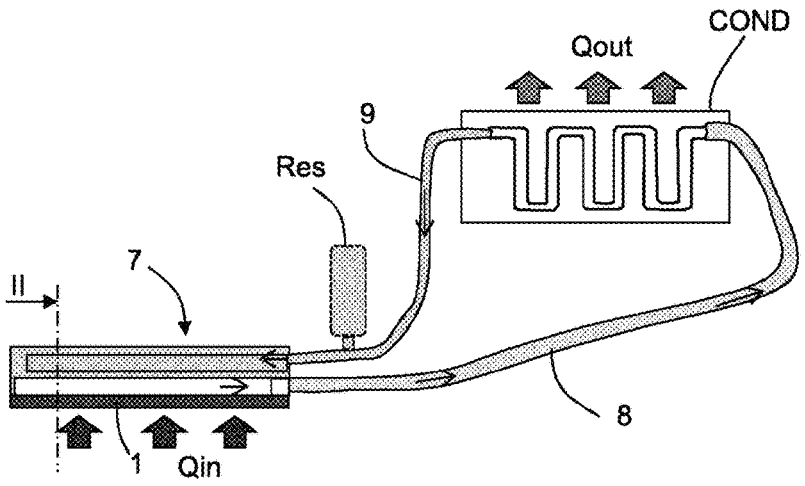
FIG. 1 is a schematic general view of a heat transfer system including an evaporator according to the invention.

FIG. 1 shows a heat transfer system comprising an evaporator 7 comprising a receiving member 1 that makes it possible to carry away a flux of thermal energy Qin received by the evaporator 7 from a dissipative component ('heat source'), towards a condenser COND which can receive this thermal energy and carry it away Qout to a 'heat sink' (ambient air, warm or cold water, radiating panel, etc.).

A vapor pipe 8 conveys the vapor produced in the evaporator to the condenser. A liquid pipe 9 makes it possible to bring the liquid condensed in the condenser back to the evaporator 7. The condenser and the pipes are assumed to be known per se and will not be described here in more detail. The evaporator, the condenser, and the pipes form a heat transfer loop, which works by using gravity (thermosiphon) or by using capillary pumping, a solution that works both on land and in a weightless configuration or against an acceleration field (gravity, movement of a vehicle), or by using pumping assisted by a mechanical pump.

In the example illustrated in FIG. 1, a reservoir RES is represented which serves as an expansion vessel for the liquid (thermal expansion of the liquid and variation of the vapor volume outside the reservoir); in the case where this reservoir is present as a separate element, we speak of a CPL (Capillary Pumped Loop). In another configuration, the reservoir function is provided inside the evaporator and in this case we speak of an LHP (Loop Heat Pipe). In the case of a "thermosiphon" configuration, the presence of the reservoir is unnecessary.

The operation of the loop in general, particularly with the vapor pipe, the liquid pipe, and the condenser, is known per se and will not be further detailed below. In the following, the description will be centered on the evaporator and its internal structure.

The evaporator 7 comprises a thermal energy receiving member denoted 1; in the first example illustrated, it is a plate 1 against which rests an element to be cooled (not shown) which supplies a flux of thermal energy denoted Qin. This plate is provided with a particular structure on the inner side of the evaporator, which will be detailed below.

The evaporator 7 in question is a capillary-type evaporator, meaning it contains a wick, in other words a porous mass, which draws liquid by capillary action, the liquid being within a liquid compartment 5 in communication with the liquid pipe 9 and the expansion reservoir RES.

It should be noted that, from a broader point of view than that of the evaporator, the term "transfer member" 1 could be used instead of the term "receiving member". In the following, the term "receiving member" may also be replaced in some cases by the term "hot plate" or "receiving plate".

Structurally, the evaporator 7 comprises the above-mentioned hot plate 1, a capillary structure which will be detailed below, the above-mentioned liquid compartment 5, and a cover-housing which makes it possible to assemble the whole together and to define a sealed interior space of the evaporator which hermetically contains the working fluid.

More specifically, the capillary structure comprises a primary wick denoted 2 supplemented by a capillary coating structure which forms a thin layer of porous material (denoted 3) which will be discussed in more detail below.

Figure 3:
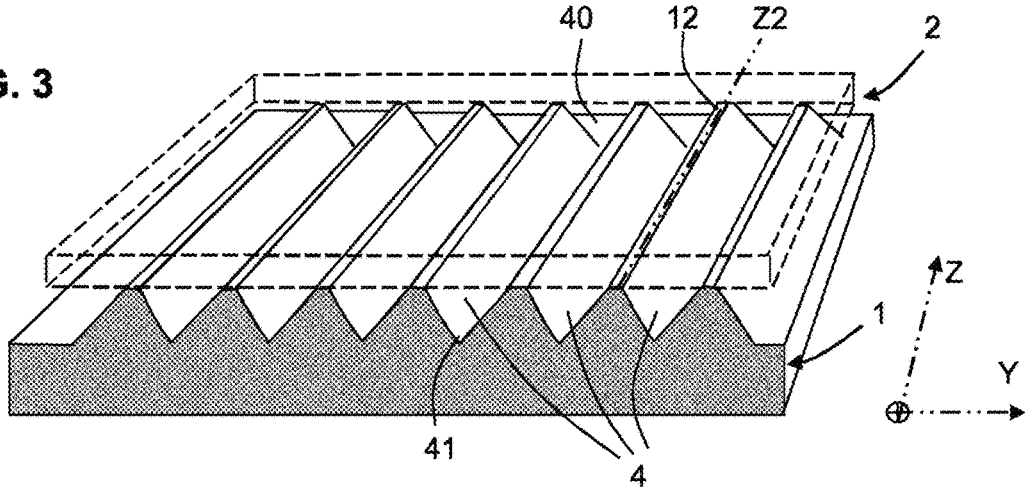
FIG. 3 represents a schematic partial perspective view of the evaporator.

According to a first embodiment illustrated in particular in FIGS. 2 to 4, the hot plate, in other words the thermal energy receiving member 1, comprises a base 10 which extends along a plane YZ in two directions Y,Z perpendicular to the depth-wise axis denoted X, and a plurality of projections 11, each extending from the base 10 to a tip 12, with side walls denoted 13.

Advantageously, the size (dimension) of each of said projections 11 decreases with the distance from the base. In other words, at least one dimension of the projection 11 decreases the further one is from the base 10. In other words, in practice, the side walls 13 are not parallel to each other.

More specifically, if we consider the cross-section of the projection in the XY plane (FIGS. 2 and 4), it has a trapezoidal shape with a wide base of dimension denoted W and a narrow tip of dimension denoted D3. The base and the tip are parallel, here parallel to the Y axis, and the side walls 13 of the projection extend obliquely at an angle β relative to the base.

Looking at the cross-section, this projection 11 can also be called a "tooth".

In the illustrated example, there is symmetry of the trapezoidal shape, more precisely with a symmetrical isosceles trapezoidal shape, where D3<0.2 W.

We can also describe this shape as frustoconical with a half-angle at the tip denoted α. Preferably we choose α<45°, or otherwise β>45°.

Preferably, the half-angle at the tip α is chosen to be comprised between 5° and 30°.

According to one particular embodiment, the small side D3 will have a size <0.3 mm.

As can be seen in FIG. 3, the projections extend with a constant cross-section along direction Z. Thus, voids are formed between said projections, shaped as grooves 4 and also referred to herein as "vaporization channels" 4 or "vapor channels".

Advantageously, it is provided that the projections 11 are adjacent to each other, neighboring projections each being separated by a vapor channel 4; we therefore note a repeating pattern along the Y axis with a pitch corresponding to dimension W which is none other than the width of the projection 11 at its base.

The height of the vaporization channels is denoted H2. In this example, the projections are formed as rectilinear ribs of trapezoidal cross-section and W represents the pitch of the repetition along the Y axis.

The primary wick, denoted 2, is formed as a thick layer of porous material; in the illustrated example, the thickness E2 of this layer is constant over the entire surface of the evaporator, which allows using an inexpensive standard product. For the thickness E2 of this primary wick, one can choose a value comprised between 1 and 8 mm, preferably between 2 mm and 5 mm.

The primary wick 2 has a front face 20 facing the receiving plate 1, and a rear face 25 in contact with the liquid 5. Optionally, the flat primary wick may be supplemented with internal walls 28 which forms a rigid structure reinforcing the mechanical strength of the evaporator. These internal walls may be porous or non-porous, depending on functional requirements for liquid distribution by capillarity.

It is not excluded to have a primary wick of non-constant thickness, as will be seen below.

For this primary wick 2, preferably a material that is a poor thermal conductor is chosen, such as nickel, stainless steel, or Teflon. In general, a material having a thermal conductivity of less than 70 W/mK, preferably less than 20 W/mK, will be chosen.

Advantageously according to the invention, the walls 13 of the projections are coated with a thin layer 3 of porous material.

Thin layer is generally understood to mean a layer of a thickness below 1 mm.

Interface plane P designates a plane parallel to YZ and adjacent to the tip 12 of the projections, and which, in the assembled state of the evaporator, is also coincident with the front face 20 of the primary wick.

One will note that the walls 13 of the projections provided with their coating define, with the front face 20 of the primary wick, the flow area of the vapor channels 4.

Returning to the thin layer 3 of porous material, according to the first exemplary embodiment, in particular illustrated in FIG. 4, its thickness is not constant on the walls 13 of the projections and preferably varies along the walls as one moves away from the primary wick; the thickest portion 31 is in contact with the primary wick, at an interface 23 located in plane P in the vicinity of the tip of each projection 12, and the thickness EC of said thin layer decreases as one moves away from the primary wick, to the vicinity of the bottom 41 of the groove where the end portion of the thin layer denoted 32 has a thickness that is more or less zero.

Advantageously, the thickness EC of the thin layer is everywhere less than 0.5 mm.

According to another possibility, it is possible to choose a value for an upper limit of the thickness EC that is less than 0.2×W.

In a preferred theoretical configuration, starting from the interface 23 in contact with the primary wick 2, an axis L is defined along the wall 13 of the projection, the thickness EC being EC1 at the abscissa L1 and decreasing as one moves along L towards the bottom 41 of the groove, where the thickness EC3 is more or less zero or at least significantly thinner than portion EC1, passing through intermediate thicknesses EC2.

Note that in the different figures, the bottom of the groove 41 is considered "isolated". In fact, because of machining constraints and/or to facilitate the creation of the thin layer 3, there may be an area not covered by the thin layer 3 of a size comparable to D3.

The thin layer 3 is ideally obtained from a material that is a good thermal conductor in comparison to the material constituting the primary wick 2, such as copper, aluminum, or nickel, having a thermal conductivity greater than 180 W/mK and preferably greater than 380 W/mK.

In an advantageous aspect, the pore diameter of the thin layer is smaller than the pore diameter of the primary wick; this makes it possible to supply liquid from the primary wick and encourage the release of vapor at the surface of the thin layer.

The base 10 of the receiving member has a thickness H1, typically comprised between 0.5 mm and 5 mm.

One will note that the tip 12 of the projections is in contact with the primary wick in a plane P over a surface area (D3×Z2) that is less than 20% of the effective surface area of the primary wick.

As can be seen in FIG. 3, the tip of the projection 12 and the primary wick are in continuous contact with each other along direction Z2; in other words, there is no interruption in the contact between the tip of the projections and the lower face of the primary wick.

For the contact surface between the primary wick and the thin layer, on each side of the cross-section, we have a width denoted D1 with $$D1=EC1/\cos(\alpha).$$

The total contact surface between the primary wick and the coated receiving plate is therefore represented as D2:

$$D2=D1+D3+D1$$

Note that D2 typically extends over 10% to 50% of the base width W. It is not excluded to increase this up to 80% in the case where the assembly of the primary wick over all the teeth is done with connection fillets (FIG. 10 right portion). This configuration is of interest in the case where significant mechanical strength or increased drainage of the two-phase liquid is required.

Furthermore, D3<0.3 mm.

Furthermore, it is possible to have D3=0, or no contact between the tooth and the primary wick, provided that there is a thickness of thin layer 3 between the tip and the primary wick 2. This configuration would make it possible to increase the thermal insulation effect of the liquid transfer zone between the primary wick and the thin layer.

FIGS. 6 and 7 show the functioning of the vaporization surface with a progressive cross-section (meaning the thin layer 3 of porous material). As the thickness of this projection 11 is significant, its efficiency in fin form is close to 1 and its thermal resistance is at least an order of magnitude lower than that due to vaporization through the thin layer 3. As a first approximation, this is the same as considering the temperature of the projection-trapezoidal fin as varying only slightly.

The thermal resistance of the thin layer, saturated or partially saturated with liquid, is inversely proportional to its thickness, which varies for example linearly between EC1 and EC3 (FIG. 4). As a result, the locally vaporized flow in the layer 3 follows a curve 61 as illustrated in FIG. 6.

The local flow (expressed in W/cm$^2$) is extremely significant at the location of the smallest thickness EC3, in other words at the base of the trapezoidal tooth 11. Due to the proposed geometry, the heat flux density decreases as one approaches the area of contact 23 with the primary wick. In the example illustrated, which also corresponds to FIG. 4, at the projection tip 12, the heat flux density is divided by 20 relative to the flux at the wall, while in prior art evaporators with straight projections or with reentrant grooves, without a thin layer 3, the heat flux is multiplied by a factor greater than 1.

A boiling phenomenon at the interface between the tip 12 of the projections and the primary wick 2 is thus avoided or greatly reduced. With these arrangements, an evaporation interface is obtained capable of processing a heat flux greater than 50 Watts/cm$^2$ on average on the external surface of the evaporator.

Advantageously, heat exchange coefficients of about 30,000 W/(m$^2$K) or higher are achieved (reference: contact surface of the receiving plate).

The inventors have been able to observe thermal energy transferred per unit area (of the receiving plate) exceeding 110 W/cm$^2$.

In FIG. 7, one can see that the thin layer makes it possible to transfer a large flow of liquid, much greater than the amount of liquid vaporized at the tip 12 of the tooth. The liquid transfer rate in the thin layer is illustrated in curve 62; this curve 62 represents the ratio QLid(h)/QLiq(L1).

The abscissa of FIG. 7 is the normalized height, in other words the ratio h/H2. H is a variable representing the height relative to the base. H2 is the total height of the projection.

The conductive flow QT(h) in the body of the tooth 11, relative to the normalized height, follows the curve denoted 63; this curve 63 represents the ratio QT(h)/QT(0) or expressed QT(h)/QT(L2) if we consider the abscissa L2 as corresponding to the base of the projection.

One will note that the majority of the thermal output travels through the lower portion of the tooth and through the thinnest portion 32 of the thin layer 3.

This proportion and the natural variations in the thickness of the thin layer 3 during manufacture, as well as the presence of defects, can cause these profiles to vary. The permeability and distribution of the pores of the thin layer 3 are therefore adapted to allow vaporization close to the base 10 in order to limit vaporization in the primary wick. Similarly, it is possible to vary the thickness of the thin layer non-linearly in order to improve the hydraulic and/or thermal properties. Linear variation is only an illustrative and simplified case of the present invention.

Note that the thin layer may have a double porosity, intentionally or due to manufacturing imperfections, namely first areas with larger pores compared to other areas where the pores are smaller; in the same spirit, the existence of discontinuities in the thin layer 3 is not excluded, meaning isolated areas or grooves having no thin layer 3 on the side wall 13 of the projection 11.

Furthermore, one will note that for the assembly of the evaporator, the proposed trapezoidal cross-section allows robust transmission of mechanical forces, particularly compressive (assembly of power modules by screwing).

According to another embodiment shown in FIG. 5, the general arrangement of the evaporator is cylindrical. The base 10 is a cylinder receiving the flux Qin; however, arrangements similar to those already described, with the appropriate modifications, are applied for the projections 11, the grooves 4, and the thin layer 3. The primary wick 2 is in the form of a tubular sleeve. The liquid compartment 5 is formed by the central area of the cylindrical interior space. The operation at the vaporization interface and the advantages conferred by the thin layer are not described in detail, as they are quite similar to what has been described above.

With reference to FIG. 8, each of the grooves or each vaporization channel 4 is connected fluidically (vapor or liquid phase) to a collector channel 40, itself connected to the outlet of the evaporator (denoted Vap_Out) which is connected to the external vapor pipe 8.

According to another exemplary embodiment shown in FIG. 9, in a sectional plane similar to that of FIG. 8, the projections 11 are arranged in the form of a conical stud or a pyramidal stud. The vapor channels 4 are then formed by the intervals between the studs. According to one advantageous option, the decreasing thickness from the top of the studs gives the advantages in terms of efficiency that have already been described above.

According to another embodiment not shown in the figures, the projections may be formed in the shape of circular ribs, in the case of an evaporator in the form of a wafer or disc.

Two variants are represented in FIG. 10, one on the left side of the FIG. (10-L) and another on the right side of FIG. (10-R).

On the right side, according to another exemplary embodiment, the thickness EC of the thin layer is almost constant. In general, in this configuration, a thickness EC of the thin layer comprised between 0.1 mm and 0.8 mm will be chosen. The operation and the efficiency of such a configuration are quite satisfactory, however without being equal to those of the thin layer of decreasing thickness as described above. In a region near the bottom of the groove (denoted 33), the thickness of the thin layer decreases rapidly to 0, in other words the groove bottom is not coated with material, the base plate is bare.

In the part in contact with the primary wick, a fillet area 39 as illustrated by a dotted area may be provided, which increases the area of contact with the primary wick. Indeed, one can see that the distance denoted D1' is substantially greater than the distance denoted D1.

On the left side 10L, according to another exemplary embodiment, the thickness EC of the thin layer is constant, including in the lower area 34 and at the bottom of the groove 35. Continuing towards the left, one can find a portion 36 of the same thickness which covers the wall of the next tooth.

One possible solution for forming such a thin layer of constant thickness (FIG. 10, side 'L') is to use a mesh 38 in the form of a metal sheet having a unidirectional framework. The mesh is shaped onto the projections, including on their sides, and is in close contact with the receiving member 1.

For this particular assembly process, the contact with the lower area 34 may leave a cavity of generally triangular cross-section.

Regarding the manufacturing method, and in a non-exhaustive manner, the preparation of the primary wick 2 consists of cutting a porous sheet of chosen thickness to the right dimensions (length and width). For the receiving member 1, we start with a copper (or nickel, stainless steel, or aluminum) plate of thickness H1+H2 and then proceed to forming the grooves and projections by removing material, either by electrical discharge machining or by conventional machining or by extrusion, stamping, or punching.

Then the thin layer 3 of non-uniform thickness (first embodiment) is formed, for example by atmospheric plasma spraying or additive manufacturing (3D printing) or placement of a mesh as illustrated above. Diffusion bonding is used to join the two porous surfaces at the contact plane P.

Assembly by compressive contact is another possible option.

It should also be noted that the thin layer 3 could also cover the tip 12 of the tooth before the assembly of the primary wick 2.

The invention claimed is:

1. A capillary evaporator for a heat transfer system, the evaporator comprising:

a thermal energy receiving member comprising a base and a plurality of projections, each projection extending from the base to a respective tip and decreasing in size as a distance from the base increases, each projection having side walls, a primary wick made of porous first material and having a front face adjacent to the tips of the projections, the side walls of the projections defining, together with the primary wick, voids forming vapor channels, and a thin layer of porous second material coating the side walls of the projections, wherein the porous second material a material that is different from the first material, wherein there is provided a fillet of porous second material extending away from the thin layer of porous second material away from the tips of the projections and wherein the fillet of porous second material is in contact with the front face of the primary wick, which increases a contact area between the porous second material and the primary wick.

2. The capillary evaporator according to claim 1, wherein the thin layer has a substantially uniform thickness.

3. The capillary evaporator according to claim 1, wherein the thin layer has a non-uniform thickness and a thickest portion in contact with the primary wick near the tip of each projection, and the thickness of said thin layer decreasing as a distance from the primary wick increases.

4. The capillary evaporator according to claim 1, wherein the projections have a shape of rectilinear ribs of trapezoidal cross-section.

5. The capillary evaporator according to claim 4, wherein the projections are adjacent to one another and each vapor channel has a generally triangular cross-section with a point directed towards the base of the receiving member.

6. The capillary evaporator according to claim 5, wherein the cross-section forms a symmetrical isosceles trapezoid, with a base W and a small side D3 such that D3<0.2 W and the small side D3 has a dimension <0.3 mm.

7. The capillary evaporator according to claim 4, wherein each tip has a half-angle that is less than 45°.

8. The capillary evaporator according to claim 1, wherein the second material is a good thermal conductor.

9. The capillary evaporator according to claim 1, wherein the thin layer has pores having a diameter that is smaller than a diameter of pores of the primary wick.

10. A heat transfer system comprising an evaporator according to claim 1, a condenser, and fluid pipes coupled to the condenser and evaporator.

11. The capillary evaporator according to claim 7, wherein the half-angle of each tip is comprised between 5° and 30°.

12. The capillary evaporator according to claim 1, wherein the first material is a poor thermal conductor.

13. The capillary evaporator according to claim 1, wherein the tips of the projections have a flat shape directly in contact with the primary wick.

14. A capillary evaporator for a heat transfer system, the evaporator comprising:

a thermal energy receiving member comprising a base and a plurality of projections, each projection extending from the base to a tip and decreasing in size the further the distance from the base, each projection having side walls, a primary wick made of porous first material and having a front face adjacent to the tips of the projections, the side walls of the projections defining, together with the primary wick, voids forming vapor channels, and a thin layer of porous second material coating the side walls of the projections wherein the porous second material is a material different from the first material, wherein the tips of the projections have a flat shape directly in contact with the primary wick wherein the thin layer has a non-uniform thickness, a thickest portion of the thin layer being in contact with the primary wick in the vicinity of the tip of each projection, and the thickness of said thin layer decreasing the further the distance from the primary wick.

15. The capillary evaporator according to claim 14, wherein each of the projections has a cross-section that forms a symmetrical isosceles trapezoid, with a base W and a small side D3 such that D3<0.2 W and the short side D3 has a dimension <0.3 mm.

16. The capillary evaporator according to claim 14, wherein there is provided a fillet of porous second material extending from the thin layer of porous second material away from the tips of the projections and wherein the fillet of porous second material is in contact with the front face of the primary wick, which increases a contact area between the porous second material and the primary wick.

* * * * *